US006868915B2

(12) United States Patent
Sans et al.

(10) Patent No.: US 6,868,915 B2
(45) Date of Patent: Mar. 22, 2005

(54) METHOD FOR SUPPRESSING DEVELOPING EXPLOSIONS

(75) Inventors: Joachim Sans, Putzbrunn (DE); Steffen Schilling, Kraiburg (DE)

(73) Assignee: Bayern-Chemie GmbH, Aschau am Inn (DE)

( * ) Notice: Subject to any disclaimer, the term of this patent is extended or adjusted under 35 U.S.C. 154(b) by 115 days.

(21) Appl. No.: 10/240,286

(22) PCT Filed: Mar. 31, 2001

(86) PCT No.: PCT/DE01/01259

§ 371 (c)(1),
(2), (4) Date: Sep. 27, 2002

(87) PCT Pub. No.: WO01/74452

PCT Pub. Date: Oct. 11, 2001

(65) Prior Publication Data

US 2003/0127234 A1 Jul. 10, 2003

(30) Foreign Application Priority Data

Apr. 4, 2000 (DE) ..... 100 16 738

(51) Int. Cl.[7] ..... A62C 35/02

(52) U.S. Cl. ..... 169/26; 169/61; 169/62; 169/77

(58) Field of Search ..... 169/28, 58, 26, 169/61, 64, 77; 149/19.6, 35, 36, 61, 77; 252/2, 4, 5

(56) References Cited

U.S. PATENT DOCUMENTS

| | | | | |
|---|---|---|---|---|
| 870,479 A | | 11/1907 | Stanley | |
| 3,897,828 A | * | 8/1975 | Glover | 169/43 |
| 4,062,288 A | * | 12/1977 | Millray | 102/531 |
| 4,637,472 A | | 1/1987 | Decima | |
| 5,305,957 A | | 4/1994 | Szocs | |
| 5,449,041 A | | 9/1995 | Galbraith | |
| 5,660,236 A | * | 8/1997 | Sears et al. | 169/72 |
| 5,992,528 A | * | 11/1999 | Parkinson et al. | 169/6 |

FOREIGN PATENT DOCUMENTS

| | | |
|---|---|---|
| DE | 35 20 546 | 6/1985 |
| DE | 199 51 886 | 10/1999 |

* cited by examiner

*Primary Examiner*—Dinh Q. Nguyen
(74) *Attorney, Agent, or Firm*—Flynn, Thiel, Boutell & Tanis, P.C.

(57) ABSTRACT

A method for suppressing developing explosions, in particular in containers or rooms with explosive dusts or gases, having a gas generator whose pressure gas expels the extinguishing agent from its container as a unit after a maximum pressure is reached and then distributes it as a cloud of extinguishing dust to the side and forwards so as to fill the space.

14 Claims, 1 Drawing Sheet

METHOD FOR SUPPRESSING DEVELOPING EXPLOSIONS

FIELD OF THE INVENTION

This invention relates to a method for suppressing developing explosions using an extinguisher whose housing (8) contains a pyrotechnic gas generator (1) and a container (5) of an extinguishing agent (6) sealed with bursting membranes (3, 4), the extinguishing agent (6) being discharged with the aid of the pressure gas generated by the gas generator (1) and distributed to the side and also accelerated forwards by the gas jet following at the speed of sound.

BACKGROUND OF THE INVENTION

For suppressing developing explosions, e.g. of mill dusts, coal dusts and solvent vapors, one has hitherto used containers under continuous pressure and filled with extinguishing agent, preferably extinguishing powder, that, when needed, blow extinguishing agent into the space to be protected via a quick opening valve. For uniform distribution, in particular lateral spreading of the extinguishing agent, a corresponding nozzle is used that customarily has the form of a hemisphere that is slotted or provided with a plurality of bores (cf. company publication "HRD-Systeme," June 1995, Total Walther Feuerschutz GmbH).

Further, fire extinguishing systems have became known that consist of tandem arrangement of a gas generator, an extinguishing agent container and an outlet opening. However, these devices are fundamentally unsuitable for suppressing a developing explosion. The reaction to an explosion must take place within the time range of a few milliseconds to effectively fight the explosion while it is arising, i.e. before the occurrence of the pressures typical of an explosion.

U.S. Pat. No. 870,479 describes an extinguishing agent cartridge wherein a central charge is triggered with the aid of freely laid fuses. Triggering is effected only by means of open fire; reaction to a developing explosion is fundamentally impossible. Powder atomization is suitable only for fighting fire.

According to U.S. Pat. No. 2,383,048, pyrotechnically generated pressure gas is introduced centrally into an extinguishing agent container with a relatively large cross section. Extinguishing agent and delivery gas are thus first mixed and then discharged together. This device, being a hand extinguisher, is equipped with only a small pyrotechnic charge, therefore also producing only a low discharge velocity and lateral distribution of extinguishing agent.

U.S. Pat. No. 5,305,957 proposes equipping an extinguisher with liquid extinguishing agent, a long, tubular acceleration path and a gas generator with low delivery pressure of about 10 bars. This obtains a high discharge velocity of extinguishing agent, but the lateral spread of the extinguishing agent jet remains low and the breakdown into droplets takes place only at a relatively large distance in front of the device due to the velocity-dependent air resistance. Thus, this extinguisher is suitable only for point-shaped fire-fighting.

Finally, DE 195 44 399 C2 from the applicant describes an assembly that is fundamentally suitable as an extinguisher for suppressing developing explosions. However, no indication is given of how to achieve an optimized extinguishing result using the known construction.

It is the problem of the present invention to state an extinguishing method suitable for suppressing developing dust explosions, for example of food dusts, in closed spaces within an extremely short time by means of a cloud of extinguishing agent dust filling the space volume.

SUMMARY OF THE INVENTION

This problem is solved in simple fashion by the features of the extinguishing method rendered in claim 1. Advantageous embodiments result from the features of the subclaims.

The inventive extinguishing method makes it possible for the first time to produce a cloud of liquid dust filling the volume of the space within less than 15 milliseconds in a limited space such as a storeroom or container when the pressure increase typical of a developing explosion has been detected by a suitable sensor. The explosion is thus caught and suppressed far before its maximum development. This effectively avoids greater damage such as the destruction of the container or room to be protected and the fire spreading after the explosion.

BRIEF DESCRIPTION OF THE DRAWINGS

The drawing FIGURE illustrates an extinguisher used with the disclosed method.

DETAILED DESCRIPTION

Figure 1:
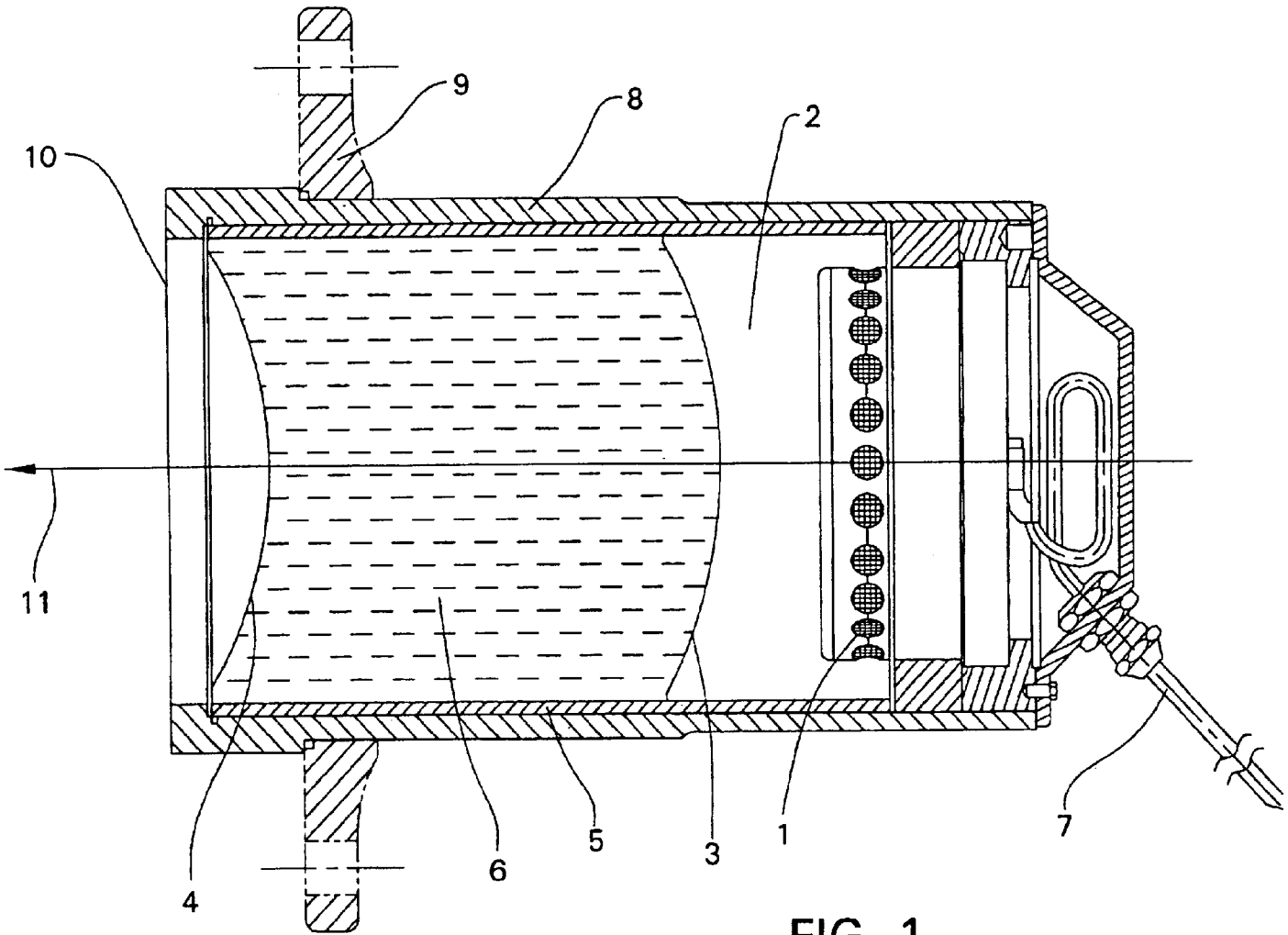

The FIGURE shows in schematically simplified fashion the basic structure of the extinguisher on which the inventive method is based. Housing 8 having the form of a pipe section contains pyrotechnic gas generator 1 to be initiated via ignition cable 7. Said gas generator permits sufficient gas generation within the short time period required for the extinguishing method. To produce the desired form of the cloud of liquid dust produced by the extinguisher, it is necessary to reach the maximum power of the gas generator, at which a gas delivery rate of 1 kg/sec is achieved, within less than 15 milliseconds, preferably in 10 milliseconds. The burning period of the gas generator is about 30 milliseconds. Only at the gas temperatures thereby occurring can the required high volume flows be produced at relatively low gas mass.

The gas generated by gas generator 1 flows into buffer volume 2 enclosed by housing 8, gas generator 1 and first bursting membrane 3 of extinguishing agent container 5. In buffer volume 2 the generated gas is stored up to a maximum pressure of 30-50 bars, preferably about 40 bars. At this maximum pressure the bursting threshold of first bursting membrane 3 is reached, which is designed so that first the arched middle area of the membrane buckles in discharge direction 11 and simultaneously the membrane shears off on the total circumference of its rim. Consequently, the second bursting membrane also shears off in the same way so that extinguishing agent 6 is subjected to the resulting pressure uniformly across its total cross section. The whole extinguishing agent is transported as a unit through aperture 10 of housing 8 in discharge direction 11. The process of atomization of liquid extinguishing agent 6 in the free space only begins directly after aperture 10.

The gas further generated after the bursting of membranes 3, 4 is discharged from housing 8 at the speed of sound, hits the extinguishing agent from behind and distributes it first at right angles to discharge direction 11 due to the inertia thereof. The lateral expansion of the cloud of extinguishing agent in this phase is three to four times the expansion in discharge direction 11. Then, increasing acceleration of the cloud of extinguishing agent is effected in the axial direction, which is accompanied by a clear increase in the spread velocity in discharge direction 11.

Successful formation of the cloud of extinguishing agent depends crucially on the required high pressure of gas generator 1, application of the pressure to the total cross section of extinguishing agent 6, the position of extinguishing agent container 5 directly at aperture 10 of housing 8 and the length-diameter ratio of extinguishing agent container 5, and the strictly circular cylindrical cross section of housing 8 without widened areas and without directing means influencing the motion of the extinguishing agent. An optimal result of distribution of extinguishing agent can be obtained only if all parameters are adjusted in accordance with the inventive method.

The use of a gas generator proves to be advantageous since the gas generation rate for the discharge of extinguishing agent and the subsequent distributing process can be adjusted within wide limits. No continuous pressure container is required. This permits the extinguisher to have a very compact construction. Maintenance and checking effort is considerably reduced. Assembly is effected by means of flange 9 in an opening of the container or room to be protected. If the gas generator generates a nontoxic gas according to the invention and water is used as extinguishing agent 6, use is also possible in rooms occupied by people or in food storage areas.

What is claim is:

1. A method for suppressing developing explosions using an extinguisher including a housing that contains a pyrotechnic gas generator and an extinguishing agent container of extinguishing agent sealed with first and second bursting membranes, the container and the first and second bursting membranes having the same diameter as the inner diameter of the housing, the extinguishing agent being discharged with the aid of pressure gas generated by the gas generator and distributed to a side and accelerated forward by the gas at the speed of sound, wherein after the gas generator has been ignited, the maximum gas delivery is reached within a short time, a buffer volume disposed between the gas generator and the first bursting membrane of the extinguishing agent container is filled up to a maximum pressure of 30 to 50 bars, when the maximum pressure is reached, the first and second bursting membranes are torn open and the extinguishing agent is discharged initially as a compact unit, the gas stream flowing after causes the extinguishing agent to be atomized in front of the housing of the extinguisher.

2. The method for suppressing developing explosions of claim 1, wherein a maximum gas generation of more than 1 kg/sec is reached in less than 15 milliseconds after ignition of the gas generator.

3. The method for suppressing developing explosions according to claim 1, wherein the discharged extinguishing agent is distributed first radially to a discharge direction in front of the housing of the extinguisher and then a distribution in the discharge direction is increasingly effected.

4. The method for suppressing developing explosions according to claim 1, wherein the extinguishing agent comprises water.

5. A device for carrying out the method according to claim 1, wherein a discharge-side end of the extinguishing agent container is disposed at an aperture of the housing of the extinguisher.

6. A device for carrying out the method according to claim 1, wherein the extinguishing agent container has a length-diameter ratio of less than two.

7. A device for carrying out the method according to claim 1, wherein the gas generator generates a nontoxic gas.

8. A method for suppressing developing explosions using an extinguisher having a single cylindrical housing that includes therein a pyrotechnic gas generator, an extinguishing agent and first and second bursting membranes, the method comprising the steps of:

providing the first and second bursting membranes as curved membranes;

providing an extinguishing agent container in the housing for the extinguishing agent between the first and second bursting membranes, the first and second bursting membranes sealing the extinguishing agent therebetween;

detecting a pressure increase typical of a developing explosion;

triggering the pyrotechnic gas generator to provide a gas stream to fill a buffer within the housing to a maximum pressure; and bursting the first and the second bursting membranes when the maximum pressure is reached so that the extinguishing agent discharges from the aperture at the end of the housing, wherein the extinguishing agent is atomized in front of the housing by the gas stream from the gas generator and is distributed.

9. The method for suppressing developing explosions of claim 8, wherein the maximum gas generation occurs less than 15 milliseconds after ignition of the gas generator.

10. The method for suppressing developing explosions of claim 8, the step of distributing the extinguishing agent comprising first distributing the extinguishing agent radially to a discharge direction and then discharging the extinguishing agent in the discharge direction, wherein the discharge direction is defined by the axis of the cylindrical housing.

11. The method for suppressing developing explosions of claim 8, wherein the extinguishing agent comprises water and the gas generator generates a nontoxic gas.

12. The method of claim 8, wherein the extinguishing agent container has a length-diameter ratio of less than two.

13. A method for suppressing developing explosions using an extinguisher having a single cylindrical housing including therein a pyrotechnic gas generator and an extinguishing agent sealed between first and second bursting membranes, the method comprising the steps of:

providing the housing with a constant inner diameter along the length thereof;

providing the first and second bursting membranes as curved membranes within the housing, the first and second bursting membranes having the same diameter as the inner diameter of said housing, the bursting membranes curving so that centers thereof are oriented away from an aperture at an end of the housing;

providing an extinguishing agent container for the extinguishing agent between the first and second bursting membranes, the first and second bursting membranes sealing the extinguishing agent therebetween, and the container having the same diameter as the inner diameter of the housing along the length thereof;

detecting a pressure increase typical of a developing explosion;

triggering the pyrotechnic gas generator to provide a gas stream of more than 1 kg/sec in less than 15 milliseconds to fill a buffer within the housing to a maximum pressure; and changing the shape of the first and second membranes and shearing the first and the second bursting membranes about a circumference thereof when the maximum pressure is reached so that the extinguishing agent discharges from the aperture at the end of the housing, wherein the extinguishing agent is atomized in front of the housing by the gas stream from the gas generator and is distributed.

14. The method for suppressing developing explosions of claim 13, the step of distributing the extinguishing agent comprising first distributing the extinguishing agent radially to a discharge direction and then discharging the extinguishing agent in the discharge direction.

* * * * *